United States Patent [19]

Keller

[11] Patent Number: 4,911,328

[45] Date of Patent: Mar. 27, 1990

[54] PRESSURE MEDIUM-DRIVEN DISPENSING APPLIANCE FOR OPERATING DOUBLE CARTRIDGE CASES

[76] Inventor: Wilhelm A. Keller, Riedstrasse 1, CH-6330 Cham, Switzerland

[21] Appl. No.: 147,798

[22] Filed: Jan. 25, 1988

[30] Foreign Application Priority Data

Jan. 26, 1987 [CH] Switzerland ..... 00252/87

[51] Int. Cl.[4] ..... B67D 5/22

[52] U.S. Cl. ..... 222/47; 222/49; 222/137; 222/389; 222/334

[58] Field of Search ..... 222/47, 49, 50, 137, 222/136, 389, 334, 326, 327, 109; 604/141, 143

[56] References Cited

U.S. PATENT DOCUMENTS

| | | | |
|---|---|---|---|
| 2,692,706 | 10/1954 | Wikstern | 222/389 |
| 2,767,885 | 10/1956 | Miller | 222/389 |
| 3,749,284 | 7/1973 | Kloehn | 222/49 |
| 3,980,209 | 9/1976 | Collar | 222/389 |
| 4,356,938 | 11/1982 | Kayser | 222/391 |
| 4,426,024 | 1/1984 | Hogan et al. | 222/389 |
| 4,471,888 | 9/1984 | Herb | 222/137 |
| 4,676,410 | 6/1987 | Flue | 222/137 |
| 4,690,306 | 9/1987 | Stäheli | 222/137 |

FOREIGN PATENT DOCUMENTS 8203377 4/1981 European Pat. Off. .

*Primary Examiner*—H. Grant Skaggs
*Attorney, Agent, or Firm*—Darby & Darby

[57] ABSTRACT

The dispensing appliance customarily built in "pistol form" for double cartridges with plunger has a pressure medium-driven cylinder/piston unit with rams extending from the piston for the forward drive of the plungers. The problem here consists in that during the piston forward thrust the reaction forces from the plungers acting upon the rams can be very different (different viscosities of the substances contained in the two cartridge cylinders and/or different cross-sections of the cartridge cylinders). In order to prevent "tilting" or jamming of the piston, the invention provides in a cylinder space a rigid longitudinal guide between both cylinder floors against which the piston is slidingly supported with a longitudinally extended guide bore. The longitudinal guide can simultaneously reinforce the cylinder and further lead the pressure medium into the pressure chamber behind the piston by way of a longitudinal channel. In this connection, rapid ventilation for the pressure chamber as well a control mechanism for guiding the piston unit back to its starting position are described. Further, a retrieval mechanism for the piston for ram relief after each forward thrust step as well as indicator elements for the cartridge fill-level are disclosed.

12 Claims, 2 Drawing Sheets

PRESSURE MEDIUM-DRIVEN DISPENSING APPLIANCE FOR OPERATING DOUBLE CARTRIDGE CASES

FIELD OF THE INVENTION

The invention relates to a dispensing appliance for operating double cartridge cases provided with plungers, with a pressure medium-driven cylinder/piston unit, holding means arranged in the region of one of the cylinder floors for accepting the exchangeable cartridges, as well as rams extending from the piston through the mentioned cylinder floor for driving the dispensing plungers forward.

BACKGROUND OF THE PRIOR ART

The double cartridge cases to be operated by the dispensing appliance serve in known manner for processing so-called two-component substances, both components of which are stored in separate cylindrical containers and, upon the plungers being acted upon, are delivered through the cartridge opening. In this arrangement, the components are customarily combined and mixed thoroughly in a static mixer adjoining the cartridge outlet. When operating double cartridges by means of dispensing appliances of the above-mentioned kind having a (most often pneumatically driven) cylinder/piston unit, the particular problem is encountered that the piston during the pressurization tends to canting and tilting because the reaction forces of the two adjacent rams acting upon the piston can be significantly different. Such differences are primarily caused by different viscosities or discharge resistances of the two components to be expelled and/or by different cross-sections of the two cartridge cases and plungers corresponding to a mixing ratio for the particular two-component system different from 1. Such unavoidable tilting momentum at the appliance piston leads, of course, easily to jamming or defective sealing of the piston or to other functional failures.

Removing these difficulties did not seem simple until today: either the two rams and especially their connection to the piston must be resistant to bending, or an excessively long piston guidance at the cylinder in connection with a cylinder wall able to resist local bulging had to be provided. Both measures, however would, as far as they would be effective at all, cause the dispensing appliance to weigh considerably more and, hence, would make the manually operated, most commonly pistol-shaped appliance difficult to handle.

It is the task of the invention of building a dispensing appliance of the mentioned kind so that widely different reaction forces by the two rams during the piston advance do not affect function and handling of the appliance in a negative manner.

SUMMARY OF THE INVENTION

The solution of the problem, according to the invention, consists in that the cylinder space contains a rigid longitudinal guide which connects both cylinder floors and penetrates the piston, against which the piston is slidingly supported through a guide bore extending in the longitudinal direction.

Such arrangement ensures in a simple manner and with little expenditure a reliable piston guide and piston seal even with pronouncedly asymmetrical loads acting on the piston. The longitudinal guide built into the cylinder effects, given normally dimensioned rams and remaining parts of the piston/cylinder unit, only an insignificant increase of the total weight and the appliance dimensions, it can, however, add to the stability of the overall piston/cylinder unit.

Useful structural embodiments in connection with the longitudinal guide according to the invention are presented herein. The longitudinal guide can, however, apart from guiding the piston straight, serve additional functions: on the one hand, with the supply of the pressure medium for the piston propulsion and, on the other hand, for guiding a retrieval element which, after each forward stroke of the piston, permits the latter to recede somewhat. Lastly, another useful expedient on the dispensing appliance is disclosed and claimed herein, namely, an indicator of the cartridge fill-level during the process of dispensing.

BRIEF DESCRIPTION OF THE DRAWINGS

Subsequently, embodiments of the dispensing appliance according to the invention are explained in detail in conjunction with the drawings, in which.

DESCRIPTION OF THE PREFERRED EMBODIMENTS

Figure 1:
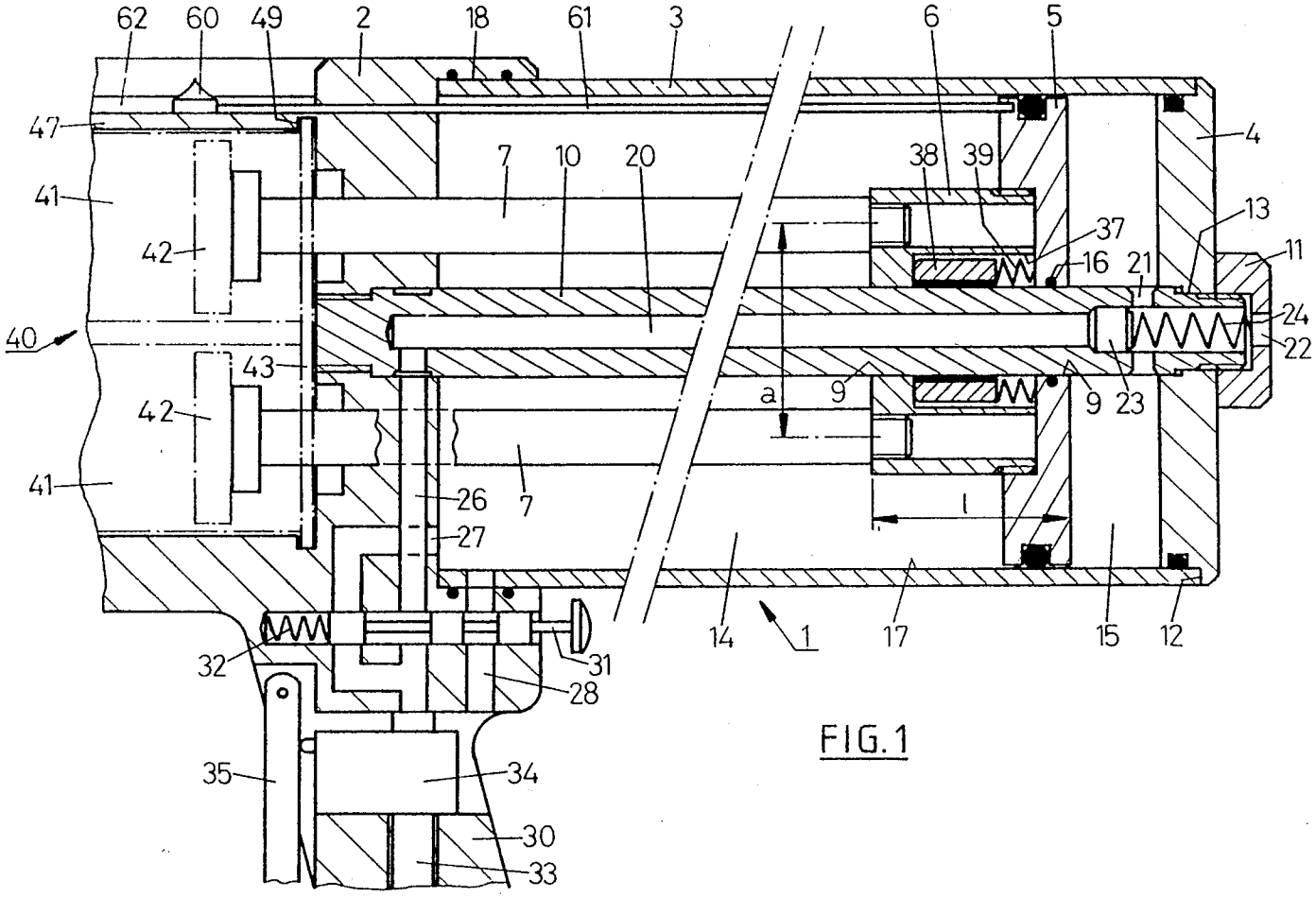
FIG. 1 is a (partially broken away) schematic longitudinal section through a dispensing appliance according to a first embodiment, with an inserted double cartridge case to be operated by the appliance being indicated with dot-dash lines.

In the pneumatically driven dispensing appliance according to FIG. 1, the cylinder/piston unit as a whole is designated 1. For ease of handling, the appliance is built "pistol shaped" with a handle 30, which, for example, is integrally formed on one cylinder floor 2 or at least is rigidly connected to it. Adjoining the cylinder floor 2 on the left hand side in FIG. 1) is an exchangeably inserted double cartridge case 40 (dot-dash lines) to be operated by the appliance, holding means for receiving the cartridge being provided, for example in the form of grooves 49 integrally formed on the cylinder floor 2 for receiving a cartridge flange 43. The double cartridges have two cylindrical supply containers 41, each with a plunger 42. Upon moving the plungers to the left the cartridge contents—the two components of a two-component system—are extruded out of the cartridge; this dispensing normally takes place stepwise as needed in several "thrusts" with waiting times in-between. For the appropriate propulsion of the two plungers the dispensing appliance has two rams 7 originating at the appliance piston and extending through the cylinder floor 2. FIG. 1 shows the situation existing when the cartridge is still nearly full, hence after the ram has only travelled a small part of the total stroke.

The pneumatic cylinder of the cylinder/piston unit 1 is composed of the already mentioned cylinder floor 2, the opposing cylinder floor 4 and the cylinder wall 3. The piston movable in the cylinder consists essentially of the piston plate 5 and a hub 6, rigidly connected to it, into which the two rams 7 are set. Essential to the present dispensing appliance is a rigid longitudinal guide 10 present in the cylinder space, which connects the two cylinder floors 2 and 4 preferentially coaxially to the cylinder axis and penetrates piston 5, 6. On this longitudinal guide, here formed as round rod, the piston is supported slidingly with a guide bore 9 extending in the longitudinal extension (in the present case divided into two sections). An annular sealing 16 set into the piston plate 5 seals the guide bore 9 against the longitudinal guide 10. The longitudinal guide 10 is, on the one hand, screwed into the cylinder floor 2. The other end of the longitudinal guide 10 projects through a through-hole 13 in the cylinder floor 4, which is held tight by a cap nut 11 tightened on the longitudinal guide 10 and rests at the periphery with an annular area 12 axially on the cylinder wall 3. The other end of the cylinder wall 3 is received by a recess 18 in the cylinder floor 2; it is self-understood that it could be supported axially analogously to the cylinder floor 4 or also be rigidly connected with the cylinder floor 2. By the fact that longitudinal guide 10 is braced under tension by the nut 11 between both cylinder floors, it lends high stability to the cylinder. Primarily, however, it reliably prevents piston 5, 6 from canting during the forward push, even in the presence of markedly different reaction forces, which by the two rams 7 are acted upon the piston. This ensures not only a disturbance-free guiding and sealing of the piston, but also a forward propulsion of the two plungers 42, which is per force "synchronous" add with it a constant volumetric ratio of the two components during dispensing from the cartridge cylinders 41. In view of good piston guidance it is recommended that its guided lengths l (length of the guide bore 9) be approximately in the range of the 0.6-fold to 1.4-fold of the ram distance a.

It should be mentioned here that the longitudinal axes of the two rams 7 and consequently the two cartridge containers 41, must not necessarily, as represented, be vertical above one another (in the projection plane in FIG. 1) but can also, depending on the position of the double cartridges in the dispensing appliance, be arranged, for example, horizontally next to each other. Even if according to FIG. 1 the longitudinal guide 10 is arranged in the center axis of the cylinder wall 3 and the two rams symmetrically on both sides of it, arrangements deviating from it, that is non-symmetrical arrangements are possible, especially if from the very outset uneven reaction forces on the rams are to be expected, especially when the cross-sections of the two cartridge cases are not the same. Lastly, by "double cartridges" of course, are meant those cartridges produced in one piece with two containers, as well as those with containers manufactured separately and to be loaded separately into the appliance.

Apart form the already described function, to brace the piston and to guide it straight over its entire stroke length, the longitudinal guide 10 can serve other purposes in connection with the dispensing appliance: it has a longitudinal channel 20 in order to lead the pressure medium into the cylinder space 15 on the side of the piston away from rams 7. The pressure gas for the piston advance is supplied through a duct 33 in the handle 30 of the appliance and dispensed by a control valve 34 actuated by means of a trigger lever 35. From the valve 34 the pressure gas reaches the longitudinal bore 20 by way of a duct 26 arranged in the cylinder floor 2, and in it flows behind the piston 5, 6 where one or several bores 21 provide a connection to the cylinder space 15. In the region of the transition, in a widened section of bore 20 is located a rapid pressure relief or air dump valve, for example a two-way valve, consisting of piston 23 and the valve spring 24. Upon actuating the control valve 34 the pressure gas in the longitudinal channel 20 displaces the valve piston 23 against spring 24 so far to the right (in FIG. 1) that it can enter the cylinder space 5 by way of bores 21 and push the appliance piston 5, 6 forward. Immediately after closing the control valve 34 (a so-called $\frac{2}{3}$ way valve which simultaneously removes pressure from duct 26 and bore 20) the valve piston 23 is pushed back by the spring into the resting position as shown and exposes a previously blocked ventilation aperture 22 for the cylinder space 15. Consequently, every time the control valve 34 is not actuated (bore 20 no pressure) the piston plate 5 is not acted upon by pressure.

Preferentially a switch valve with multiple control piston 31 and valve spring 32 is provided, which is connected between the outlet of the control valve 34 and the cylinder space 14, which is on the ram side of the appliance piston 5, 6. The control piston 31 can be operated simultaneously with the hand lever 35, for example, with the thumb of the hand gripping the carrying handle 30. In the shown resting position of the switch valve the piston 31 on the one hand frees the pressure medium duct 26 and, on the other hand, a ventilation duct 28, through which during the forward thrust of the appliance piston 5, 6 the air can escape from the cylinder space 14. The switch valve 31, 32 serves to bring the appliance piston 5, 6 with rams 7 into the starting position (right in FIG. 1) in order to prepare for an exchange of the cartridges 40. If the switch piston 31 is displaced to the left against spring 32, the pressure medium duct 26 and the ventilation duct 28 are blocked, while a pressure medium channel 27 previously blocked and leading from the outlet of valve 34 to the cylinder space 14 is opened. Consequently, if both the control valve 34 and the switch valve 31, 32 are actuated simultaneously, the cylinder space 14 is pressurized by the pressure gas and the appliance piston 5, 6 is displaced to the right with the valve piston 23 remaining in the resting position and the ventilation of the cylinder space 15 taking place by way of bore 21 and opening 22. It is, of course, also possible to connect channel 27 directly with the pressure medium duct 33 instead of branching from duct 26; in that case, to guide the piston 5, 6 back, only actuating the valve 31, 32 is required.

The mentioned rapid ventilation of space 15 and hence removal of the pressure load from the piston plate 5 is of importance insofar as it can be desirable to clearly interrupt after each piston and ram forward thrust the pressurization of the plungers 42 in the cartridge 40 through rams 7. Such relief of the plungers 42 after partial dispensing of the cartridge content contributes to the fact that an undesirable after-flow at the end of a dispensing step (closure of control valve 34) is prevented. With an additional measure in the region of the appliance piston 5, 6 for which likewise the longitudinal guide 10 can be utilized, it is achieved, that the rams 7 with each pressure relief of the cylinder space 15 are lifted by a small amount off the plungers 42: for this purpose in a recess 37 in the interior of the piston hub 6 an annular retrieval element 38 and one or several retrieval springs 39 are located. The retrieval element 38 is movable along the longitudinal guide 10 under friction. The retrieval springs 39 are supported between the retrieval element 38 and the piston plate 5, and between the retrieval element and the piston limited axial relative motion is possible. At the beginning of the piston forward thrust (pressurization of space 15) first the pressure springs 39 are loaded, and subsequently after the piston has become somewhat displaced in the axial direction relative to the retrieval element and the spring force overcomes the friction of the retrieval element on the longitudinal guide 10, the retrieval element within the hub 6 is taken along. At the end of the forward thrust and after ventilation of space 15 the retrieval element 38 remains stationary on the longitudinal guide while the springs 39 relax and move the piston back in the direction opposite the forward thrust direction by the amount of the previously traveled stroke of the springs; here, the precondition is that the frictional force of the retrieval element on the longitudinal guide 10 is greater than the total frictional forces acting upon the piston 5, 6.

Figure 2:
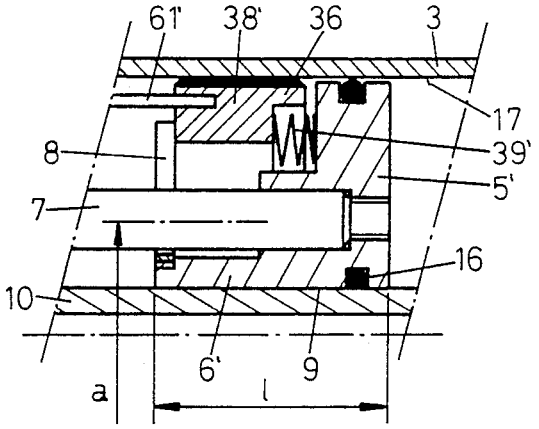
FIGS. 2 and 3, as variants to FIG. 1, each represent half sections through the piston part according to other models.

A variant of the described retrieval arrangement is represented in FIG. 2 and parts corresponding to each other are referred to with the same reference symbol. In this variant the cylinder inside surface 17, instead of the longitudinal guide 10, is used as friction surface for the likewise annular, however correspondingly greater retrieval element 38'. Retrieval springs 39' are again braced between the retrieval element 38' and the piston 5', with a stop 36 functioning as precise delimiter of the possible axial motion between parts 38' and 5'. On the side opposite the springs 39' a dog 8 for the retrieval arrangement is located, connected to the hub 6' and effective during the travelling of the piston back into the starting position. As is evident, the piston plate 5' and the hub 6' can be made of one piece and guide bore 9 made supporting over its entire length. The mechanism of action of the retrieval arrangement according to FIG. 2 is the same as in the arrangement according to FIG. 1.

When using the dispensing appliance neither the particular position of the appliance piston 5, 6 with the rams 7 nor the corresponding position of the plungers 42 within the cartridge 40 are visible from the outside. The present appliance is therefore provided with a useful indicator element shown as example in FIG. 1, which at any time during dispensing permits reading the actual cartridge fill-level. The indicator element has a push rod 61 here connected directly to the piston plate 5, extending through the cylinder floor 2 on the cartridge side and on the outside of it carrying a pointer 60. The latter slides in a guideway adjoining the cylinder floor 2 and is, for example, provided with a fill-level scale. The guideway 62 as shown is provided in a support 47 of the dispensing appliance connected to the cylinder floor 2, however,—when omitting the support—guideway and/or scale can also be provided directly on the cartridge 40.

Figure 3:
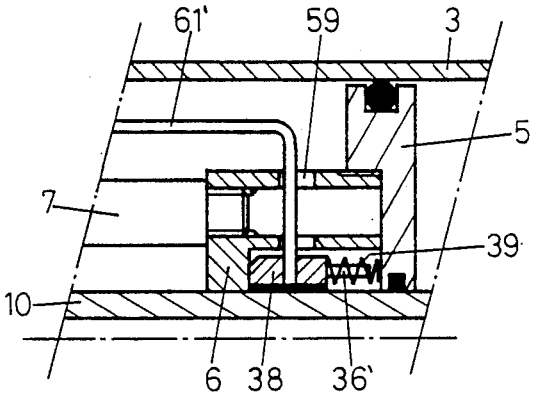

With regard to the described retromotion of the piston and rams caused after each forward thrust step by the retrieval arrangement 38, 39 (or 38', 39' respectively), the indicator element advantageously may be connected to the retrieval element instead of to the appliance piston directly, in order to achieve an even more precise indication of the cartridge fill level. This is illustrated in the example according to FIG. 2 by the push rod 61'. A construction analogous with respect to mechanism of action is evident in FIG. 3 in a retrieval element 38 sliding according to FIG. 1 along the longitudinal guide 10. There, the push rod 61' is bent at an angle within the cylinder and connected with the retrieval element 38, with a radial bore 59 in the hub 6 providing sufficient freedom of motion in the axial direction. The relative motion between piston unit 5, 6 and retrieval element 38 can, according to FIG. 3, be precisely limited by stops 36'.

An indicator element displaceable as a function of the motion of the appliance piston and extending through one of the cylinder floors, as described above, could also be used to advantage in dispensing appliances with only one ram (for single cartridges).

Lastly, it should be mentioned that all measures according to the invention are also applicable within the meaning of the invention on dispensing appliances with more than two rams, thus, for triple or multiple dispensing cartridges, should such systems be introduced.

What is claimed is:

1. In a dispensing appliance for operating at least double cartridges provided with plungers, with a pressure medium-driven cylinder/piston unit, with holding means arranged in the region of one of two cylinder end walls for the exchangeable holding of the cartridges as well as rams starting from the piston and extending through said one cylinder end wall for driving forward the plungers, the improvement comprising that said piston is adapted to receive a tilting or canting moment due to unequal reaction forces applied to said rams external to said cylinder and, for accommodating the unequal reaction forces, that the cylinder space contains a rigid longitudinal guide extending between said cylinder end walls, a guide bore defined by a guide bore wall being provided, the piston sliding along said guide by means of said guide bore penetrated by the guide, so that the guide, by way of the wall defining said guide bore, providing guidance to the piston so as to withstand the tilting moment exerted by the rams.

2. Dispensing appliance as in claim 1, wherein the wall defining the guide bore is provided with an annular seal slidable against the longitudinal guide formed as a round rod.

3. Dispensing appliance according to claim 1 or 2, wherein the guided length (l) of the piston is 0.6-fold to 1.4-fold the distance (a) between the rams.

4. Dispensing appliance as in claim 1, wherein the longitudinal guide is braced under tension between both cylinder end walls, at least one of which bearing, by way of an annular surface, axially on the cylinder wall.

5. Dispensing appliance as in claim 1, wherein the longitudinal guide has a longitudinal channel for the pressure medium supply into the cylinder space on the piston side facing away from the rams.

6. Dispensing appliance as in claim 5, wherein at the transition from the longitudinal channel into the mentioned cylinder space a pressure medium-driven rapid pressure relief is arranged having a piston of which is uncovering a ventilation opening for the cylinder space when the pressure on the longitudinal channel is released.

7. Dispensing appliance as in claim 5, wherein the longitudinal channel is connected by way of a pressure medium duct arranged within the cylinder end wall on the cartridge side, with a control valve located in a handle of the appliance.

8. Dispensing appliance as in claim 7, wherein a change-over valve, having an input duct connected to said control valve, is connected to the cylinder space located on the piston side towards the rams, which in a first position provides a ventilation opening originating in said cylinder spaced and blocks a pressure medium channel leading to said cylinder space, and in a second position blocks the ventilation opening and provides the pressure medium channel.

9. In a dispensing appliance for operating double cartridges provided with plungers, with a pressure medium-driven cylinder/piston unit, with holding means arranged in the region of one of two cylinder end walls for the exchangeable holding of the cartridges as well as rams starting from the piston and extending through said one cylinder end wall for driving forward the plungers, the improvement comprising that the cylinder space contains a rigid longitudinal guide extending between said cylinder end walls, a guide bore defined by a guide bore wall being provided, the piston sliding along said guide by means of said guide bore penetrated by the guide, whereby the guide, by way of the wall defining said guide bore, providing guidance to the piston so as to withstand any tilting momentum due to unequal driving forces exerted by the rams, and wherein a retrieval element is frictionally guided at the cylinder interior surface, which relative to the piston is movable to a limited extent in the longitudinal direction and is resting against the piston via at least one retrieval spring loadable during the piston forward stroke.

10. Dispensing appliance as in claim 9, wherein the retrieval element and the retrieval spring(s) are arranged within a piston hub between longitudinal sections of the guide bore.

11. In a dispensing appliance for operating cartridges provided with plungers, with a pressure medium-driven cylinder/piston unit, holding means arranged in the region of one of two cylinder end walls for the exchangeable reception of cartridges as well as at least one ram extending from the piston and extending through the mentioned cylinder end wall for the plunger forward drive, the improvement comprising an indicator element for the cartridge fill-level, said element extending from the inside of the cylinder through one of the cylinder end walls to the outside and being displaceable as a function of the motion of the piston, and wherein the indicator element is connected to a movable piston retrieval element having longitudinally limited travel relative to the piston.

12. In a dispensing appliance for operating double cartridges provided with plungers, with a pressure medium-driven cylinder/piston unit, with holding means arranged in the region of one of two cylinder end walls for the exchangeable holding of the cartridges as well as rams starting from the piston and extending through said one cylinder end wall for driving forward the plungers, the improvement comprising that the cylinder space contains a rigid longitudinal guide extending between said cylinder end walls, a guide bore defined by a guide bore wall being provided, the piston sliding along said guide by means of said guide bore penetrated by the guide, whereby the guide, by way of the wall defining said guide bore, providing guidance to the piston so as to withstand any tilting momentum due to unequal driving forces exerted by the rams, and wherein a retrieval element is frictionally guided on the longitudinal guide, which relative to the piston is movable to a limited extent in the longitudinal direction and is resting against the piston via at least one retrieval spring loadable during the piston forward stroke.

* * * * *